US005697614A

United States Patent [19]

Potter et al.

[11] Patent Number: 5,697,614

[45] Date of Patent: *Dec. 16, 1997

[54] METHOD OF PLAYING A BANKING TYPE WAGERING GAME

[76] Inventors: Bruce H. Potter; Deborah J. Potter, both of P.O. Box 305, Surfside, Calif. 90743

[ * ] Notice: The term of this patent shall not extend beyond the expiration date of Pat. No. 5,494,295.

[21] Appl. No.: 607,127

[22] Filed: Feb. 26, 1996

Related U.S. Application Data

[63] Continuation-in-part of Ser. No. 369,099, Jan. 5, 1995, Pat. No. 5,494,295.

[51] Int. Cl.[6] ..... A63F 1/00

[52] U.S. Cl. ..... 273/292

[58] Field of Search ..... 273/292, 309, 273/274

[56] References Cited

U.S. PATENT DOCUMENTS 5,265,882 11/1993 Malek ..... 273/292
5,494,295 2/1996 Potter et al. ..... 273/292

*Primary Examiner*—Benjamin H. Layno

[57] ABSTRACT

Methods of playing banking type wagering games wherein a plurality of different sets of predetermined hand ranking rules are utilized by a single hand. A player is provided with an initial single hand and decides from that initial hand which set(s) of predetermined hand ranking rules to apply to that hand. The player may apply any number of the hand ranking rules to the hand. After the player has decided which set(s) of predetermined hand ranking rules to utilize, the player may receive additional cards to complete their hand. The player's goal is either to achieve one or more predetermined minimum winning hand ranks, or to beat one or more of a plurality of "bank" hands, with each "bank" hand being played by a different set of predetermined hand ranking rules. The layout of the table could include boxes or lines or areas which the player could utilize to indicate which set(s) of predetermined hand ranking rules they chose to apply to their hand.

33 Claims, 2 Drawing Sheets

METHOD OF PLAYING A BANKING TYPE WAGERING GAME

This is a continuation-in-part of Ser. No. 08/369,099, filed 1995 Jan. 5, now U.S. Pat. No. 5,494,295, granted 1996 Feb. 27.

BACKGROUND

1. Field of Invention

The present invention pertains to the field of games, more specifically banking type games suitable for play in casinos for money wagers.

2. Description of Prior Art

Games are considered educational, exciting, stimulating, encourage human communication, and test the strategic abilities of an individual. When the added factor of wagering is included in a game, all of the elements mentioned above are greatly heightened. The two different methods of operation for wagering games are poker type and banking type. Poker type wagering games involve at least two players playing against each other. Banking type wagering games involve at least one player playing against a "bank." A "bank" is simply a pool of money typically owned by the casino. The "bank's" hand or hands are run by either a dealer who is an employee of the casino, a gaming device or machine, such as a video or slot machine, that is owned by the casino, or against a "bank" player who is not associated with the casino, in the later case the "bank" is typically owned by the "bank" player.

Wagering games are played in casino's by a wide variety of players, from beginner to skilled professional. Players enjoy variable combinations of relatively simple, fast-moving wagering games. Many poker type wagering games have an added level of excitement wherein the players utilize multiple hand ranking rules within a single game. For example, many poker games are played high/low split. The object of a high/low split poker game is to make a better Standard Poker hand or a better Lowball Poker hand than any other player. The player with the best Standard Poker hand will win half of the total amount wagered, i.e. the "pot" and the player with the best Lowball Poker hand will win the other half of the pot. Games with multiple hand ranking rules have become increasingly popular in casinos, and are in large demand. This demand, however, has only been met by poker type wagering games, not by banking type wagering games. The field of banking type wagering games utilizes a wider variety of hand ranking rules than the field of poker type wagering games, but has not yet found a method to play more than one of the wide variety of hand ranking rules in a single game.

Banking type wagering games can employ cards, tiles, dice, dominos, etcetera, and are played against a "bank." In some banking type wagering games, there is no "bank" hand to play against. When there is no "bank" hand, the object is to reach a certain minimum winning hand rank. In other banking type wagering games, the goal of the player is to beat the "bank" hand. In blackjack, for example, cards are employed, and each card is assigned a predetermined point value. Each player's hand that is closer to twenty-one points than the "bank" hand, without going over twenty-one points, will be paid an amount equal to their original wager.

One banking type wagering game, Multiple Action Blackjack, protected under U.S. Pat. No. 5,257,789 to Le Vasseur (1993) allows each player to play their hand against any number of a plurality of dealer hands. This concept increases the excitement, speed, and revenue of a game, because the player has the opportunity to play against more than one dealer hand, per round of play. In this game, however, there is only one predetermined set of hand ranking rules, Blackjack. This method of play still limits variety, mental stimulation, and the test of strategic abilities that is provided by wagering games. A single banking type wagering game that could offer multiple hand ranking rules would broaden the field of banking type wagering games, and would be welcomed by both casinos and players.

OBJECTS AND ADVANTAGES

Currently, within each banking type wagering game, only one single set of hand ranking rules can be offered. It is an object of the present invention to provide a method whereby a player can play a single hand against a plurality of hand ranking rules within a single banking type wagering game.

It is an advantage of the present invention that players are provided with an alternative set of hand ranking rules to play their hand against. This provides a player with a selection of, essentially, multiple different games, within a single game. This concept of utilizing multiple different hand ranking rules within a single game provides a higher level of strategy than has ever been achieved within a banking type wagering game.

Still further objects and advantages will become apparent from a consideration of the ensuing detailed description.

REFERENCE NUMERALS

Figure 1:
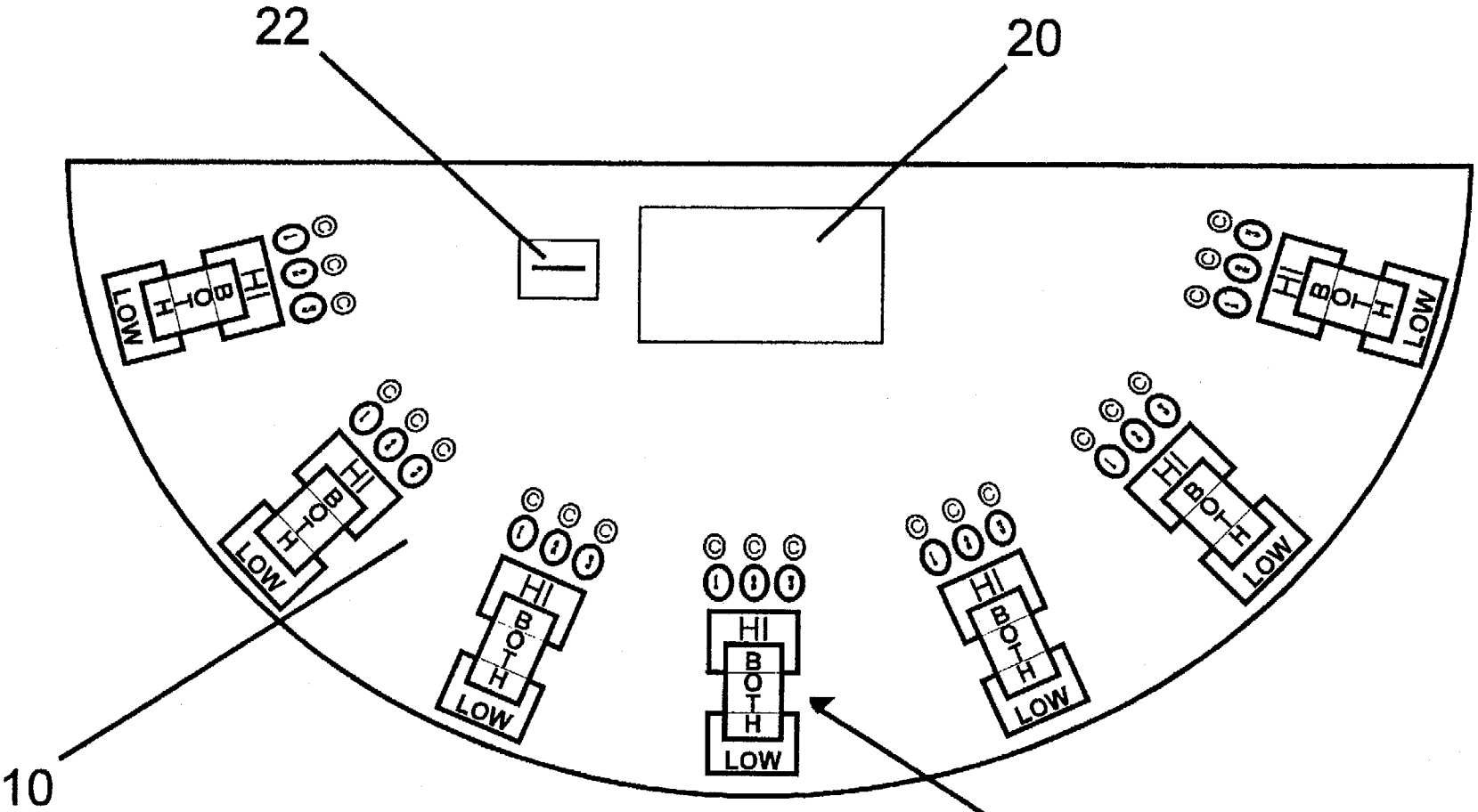
FIG. 1 shows the top view of a useful playing surface for one embodiment of the present invention.

10 playing surface
12 player station
14 wager area
16 house collection area
18 decision area
20 chip tray opening
22 house collection slot
24 supplemental or "backline" wager area

SUMMARY

The present invention is novel in the field of banking type wagering games, wherein a player is given the opportunity to play a hand using game pieces, such as cards, tiles, dice, dominoes, etcetera, against a plurality of independent different hand ranking rules. The preferred embodiment utilizes playing cards and standard poker values that are known to skilled players, and easily learned by beginners. In the preferred embodiment the "bank" receives two independent hands, one that utilizes the hand ranks of standard poker and one that utilizes the hand ranks of lowball poker. Once each player has received four of their five cards, each player decides which of the dealers hands to play against, with the option of playing against both, then each player receives their fifth, and last, card. At this point the "bank" hands are exposed and each players hand is compared to the specific "bank" hand, or hands, that they played against, winners are determined, and wagers are settled.

Other embodiments of the present invention involve playing cards that utilize a predetermined point value where the object is to get the closest to one or more of a plurality of predetermined different point values. Other embodiments can utilize a plurality of different rank combinations, such as a point total hand and a standard poker hand. Further embodiments will utilize three or more different hand ranking rules.

DETAILED DESCRIPTION

The present invention provides a concept that will become apparent from the ensuing descriptions, that is completely novel to the field of banking type wagering games, wherein players can play a single hand and have the opportunity to choose from multiple different hand ranking rules within one game.

Figure 2:
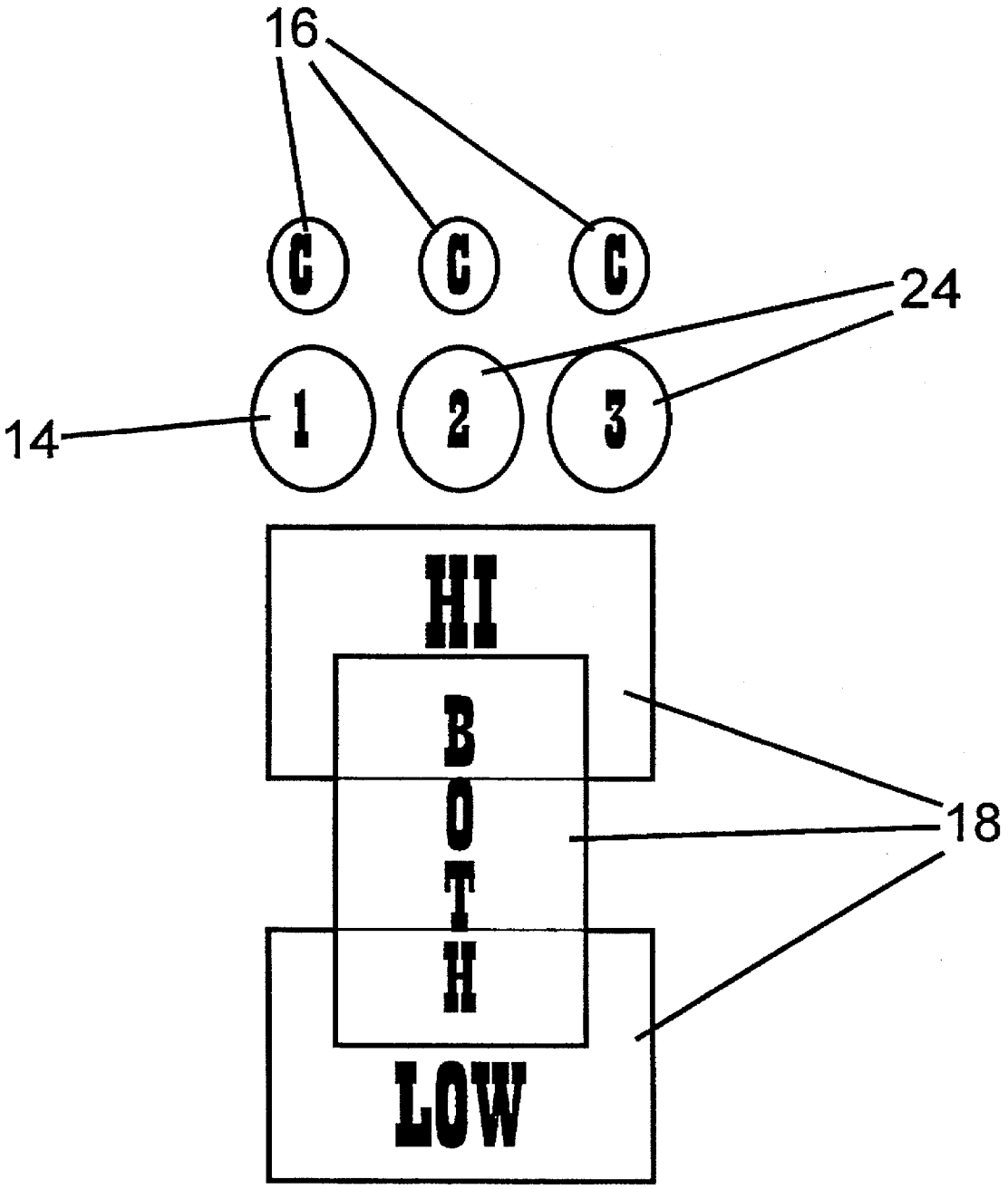
FIG. 2 is a detailed view of a player station 12 on FIG. 1.

According to one preferred embodiment of the present invention, a playing surface 10 such that is illustrated in FIG. 1 comprised of a dealer station which includes a chip tray opening 20, and a house collection slot 22. A player station 12 as illustrated in FIG. 2 is provided for each player. Each player station 12 is comprised of a wager area 14, a house collection area 16, a decision area 18, and a supplemental or "backline" wager area 24. Playing surface 10 illustrated in FIG. 1 is arranged with seven player stations 12. The actual number of player stations 12 may vary as desired by the casino.

The illustrated embodiment is written for casinos in highly regulated jurisdictions, where the casino is not permitted to participate in the game, but rather furnishes playing surface 10 and a dealer who does not play, a small percentage of the amount wagered is typically charged for providing these services. In casinos in less regulated jurisdictions the casino will act as the "bank." The dealer's responsibilities are to determine that all the wagers placed by the players are within the wagering limits as set by the casino, deal the cards, collect the casino's portion of each wager (if applicable,) declare winners and settle the wagers. In highly regulated jurisdictions the dealer is also responsible for determining which player will take on the position of "bank" or banking the game, according to the rules of the casino. The "bank" typically receives a button or chip marked "bank," and the player is allowed to bank up to two consecutive rounds. The position of "bank" is then typically passed to the next player who wishes to "bank" the game. In less regulated jurisdictions the casino can allow the players the option to "bank" the game, however, this is not typically done.

In this illustrated embodiment, two different sets of hand ranking rules are implemented. The first is Standard Poker ranks, in descending order, Royal Flush, Straight Flush, Four of a Kind, Full House, Flush, Straight, Three of a Kind, Two Pair, One Pair, and High Card. The second is Lowball Poker ranks, wherein the winning hand contains the lowest cards and no pairs (two or more cards of the same value,) the best hand is Ace, 2, 3, 4, 5, the second best hand is Ace, 2, 3, 4, 6, third best hand is Ace, 2, 3, 5, 6, and so on. In the case of pairs the hand with the lowest pair (Aces are considered as the lowest card in lowball poker) is the winning hand.

The game is played with a fifty-three card deck wherein a joker is added to a standard deck of fifty-two cards, therefore limiting the game to a maximum of eight players and the "bank." A standard deck of fifty-two cards may be used without the joker, or more than one joker may be added to a standard deck of fifty-two cards as desired by the casino or by the players. A joker is typically used as an Ace, or to complete a Straight or Flush hand in standard poker. In lowball poker the joker is typically played as the lowest card Ace, 2, 3, 4, or 5 which is not one of the other four cards already in the hand.

Once all wagers have been placed, and the "bank" has been selected, according to the rules of the casino, the hand begins. The dealer will then deal an initial hand of four cards face down singly in clockwise rotation starting from the "bank," with the "bank" receiving two independent hands during the deal. The "bank" hands are to be kept in front of chip tray opening 20, one in the upper left hand corner, and the other in the upper right hand corner, and are not to be commingled or combined, and are not to be exposed. One of the "bank" hands will be played (Hi) using the Standard Poker hierarchy explained above, and the other "bank" hand will be played (Low) using the Lowball Poker hierarchy also explained above.

Upon examining their initial hand of four cards the player must apply at least one of the sets of hand ranking rules to the hand, either Hi, Low, or both, then place their cards face down within the proper one of the three fields of decision area 18 in FIG. 2. Depending upon what is desirable to the casino, the rules can be written whereas a player must double their wager in order to play their partial hand against both "bank" hands. Once all players have set their hands in decision area 18 the dealer will announce "last card."

The dealer then deals one final card to each hand, thus completing both "bank" hands and each player hand; this completes the deal. The dealer then exposes the "bank" hands and announces the value of each independent hand, and designates which hand will play Hi, and which will play Low. When there is any question as to which hand is Hi or Low, the decision wrests completely with the "bank" player. For example, if one "bank" hand is the 8, 7, 5, 3, and 2 of hearts, and the other "bank" hand is a Two Pair. The "bank" player must designate whether to play the 8, 7, 5, 3, and 2 of hearts hand as a Flush for Hi, therefore leaving the "bank" with a Two Pair for Low, or whether to play the Two Pair for Hi, therefore leaving the "bank" with an 8, 7, 5, 3, 2 for Low. If the casino is the "bank" then a rule must be made as to which hand will play Hi and which hand will play Low. A suggested rule is to apply Standard Poker rules to the hand with the highest Standard Poker rank. Once the "bank" hands have been determined and designated Hi and Low, the dealer will then, in rotation, expose each players' five-card hand, compare it to the specific "bank" hand or hands with the identical set of rules they chose to apply to their hand, (Hi or Low,) determine the winner and settle the wagers. Any player that decided to play against both of the "bank" hands will play half of their total wager against each specific "bank" hand.

The preferred embodiment can also employ a draw; that is to allow the players to alter their hand by exchanging a number of cards from their five card hand, and receive the same number of cards from the deck in return. This could be implemented into the above embodiment a number of ways. One way to implement the draw would be after the player has applied a set of hand ranking rules Hi, Low, or both and received their last card. The player will be allowed a draw in turn in an effort to improve the hand. No player will be allowed to change their decision before or after the draw. The "bank" will be given the option to draw after the "bank" hands have been designated Hi and Low; The rules could also allow the player to receive all five of their cards before making their decision and then make a draw. In this case the "bank" hands could draw prior to the Hi/Low designation. Another way to implement the draw would be to allow the player to make the Hi/Low decision after the draw is completed. Other implementations of the draw could force the player and/or the "bank" to draw, or allow the player a draw and not allow the "bank" a draw, or vice Versa.

Other embodiments of the present invention provide the player with a plurality of different predetermined hand ranking rules each with its own minimum winning hand rank, wherein there are no "bank" hands to play against. In one embodiment for example, which utilizes the same predetermined hand ranking rules as the preferred embodiment above, each players hand must achieve One Pair of tens or higher to win for standard poker (Hi,) or a 9, 8, 7, 6, 5, or lower to win for lowball (Low,) with certain combinations having a higher payout, e.g. a Royal Flush will have the highest payout and One Pair of tens will pay even money for a hand played Hi. Each player is dealt a hand and must apply at least one of the predetermined hand ranking rules, Hi, or Low, before receiving the remainder of the hand. In this embodiment a player that plays a hand both ways will receive the specified payout on each goal, Hi, or Low, for half of the total wager. For example, a player with 9, 8, 7, 6, 5, of varied suit, who decided to play the hand to both objectives (Hi and Low) will receive even money for half of their wager for a winning low combination, and will receive the predetermined payout for a Straight on the other half of their wager. However, a player with an 8, 7, 6, 5, 2, of varied suit, who decided to play the hand to both objectives (Hi and Low) would receive the predetermined payout for an "8" low on half of the wager and would lose half of the wager. The rules could also be written to allow the player to win if their hand achieves either of the minimum winning hand ranks Hi or Low.

This embodiment could also utilize a draw wherein the players would be dealt an initial hand of five cards. The player will apply at least one set of rules to their hand by deciding Hi/Low or both. Then the player must decide how many cards to exchange, (zero (0) to five (5.)) If preferred the Hi/Low or both decision could be made after this draw is completed, in this case the player would not be making the actual decision, the Dealer would simply provide the player with the correct payout, if any of the minimum winning hand ranks or greater has been achieved, and collect the players wager in no minimum winning hand rank is achieved.

According to another embodiment, recognized card values are used where picture cards are worth ten, number cards are worth their respective numerical value, and aces are worth one or eleven at the players option. The "bank" hands in this game are played low and high with the winning low hand being the one closest to seven, and the winning high hand being the one closest to twenty-seven. In this embodiment each player is dealt an initial hand of three cards. Each player then must decide which "bank" hand to play their hand against, high, low, or both. After their decision is made, each player has the option of receiving one additional card in an effort to improve their hand. Once all players have decided high, low, or both, and have received their additional card, if desired, the "bank" hands are exposed. The "bank" hand with the lowest point total is low, and the "bank" hand with the highest point total is high. The "bank" also has the option of taking an additional card in an effort to improve these hands.

This embodiment could also utilize the rules of more recognized card games such as Baccarat and Blackjack. In which case players would be dealt an initial hand of two cards and would be allowed to alter their hand by taking multiple additional cards or "hits" in an effort to improve their hand toward the applied set of rules. Depending on the preferences of the Casino the rules of this embodiment could be written with the players making their Blackjack/Baccarat decision either prior to taking any "hits" or after their hand is complete.

Another embodiment utilizes a combination of the above embodiments wherein the "bank" has three independent hands with the low hand played by Baccarat, the high hand played to Blackjack, and the third hand played best Standard Poker value (poker.) Upon receiving their initial hand, each player must apply at least one set of the afore mentioned hand ranking rules by deciding which "bank" hand to play against; Blackjack, Baccarat, poker, or any combination of the three. In this game a player with three aces and a six as their final hand would have a very good chance of winning against all three of the "bank" hands.

An alternate embodiment where the "bank" has no hand could utilize a combination of the above rules, this embodiment would provide the rules of Blackjack, Baccarat, and Seven-and-a-Half. The minimum winning hand ranks would be seventeen for Blackjack, seven for Baccarat, and six for Seven-and-a-Half. In this embodiment a player with a seven and a face card as their hand would be able to get a minimum payout for Blackjack and Baccarat, and the maximum payout for Seven-and-a-half. However, a player with an Ace and a face card would receive the maximum payout for Blackjack, and no payout for Baccarat or Seven-and-a-Half.

Any of the above embodiments might also be played in an electronic version wherein playing surface 10 would be replaced by a electronic video screen, and the methods disclosed above would be programmed into the various components of the video gaming device.

Conclusions, Ramifications, and Scope

Accordingly, it is apparent that the present invention provides a method whereby a player can play a single hand against a plurality of different game rules within a single banking type wagering game.

Although the description above contains many specificities, these should not be construed as limiting the scope of the invention but as merely providing illustrations of some of the presently preferred embodiments of this invention. For example, versions of the above described embodiments could be incorporated into electronic gaming devices, wherein the dealer would be replaced by electronic hardware and software. It is also apparent from the above detailed description that many other embodiments of the present invention could be written utilizing any number of different game rules in many different combinations.

Thus the scope of the invention should be determined by the appended claims and their legal equivalents, rather than by the examples given.

We claim:

1. A method of playing a card game between a dealer and at least one player comprising the steps of:

a dealer providing a plurality of independent bank hands, wherein said plurality of independent bank hands are never commingled or combined, wherein a different set of predetermined hand ranking rules is applied to each said independent bank hand, said dealer providing a player with only a single hand, upon viewing said single hand, said player applying at least one of said different set of predetermined hand ranking rules to said single hand, a comparison being made between said single hand and all of said plurality of independent bank hands that utilize a identical set of hand ranking rules as said single hand, and upon completion of said comparison, a winning hand is determined using said identical set of hand ranking rules as a criteria.

2. A method of playing a card game according to claim 1 wherein the number of said plurality of independent bank hands is two.

3. A method of playing a card game according to claim 2 wherein said different predetermined sets of hand ranking rules are Standard Poker and Lowball Poker.

4. A method of playing a card game according to claim 2 wherein said different predetermined sets of hand ranking rules are Blackjack and Baccarat.

5. A method of playing a card game according to claim 1 wherein the number of said plurality of independent bank hands is three.

6. A method of playing a card game according to claim 5 wherein said different predetermined sets of hand ranking rules are Blackjack, Baccarat, and Seven-and-a-Half.

7. A method of playing a card game according to claim 1 further comprising the step of said player altering said single hand prior to said comparison.

8. A method of playing a card game according to claim 1 further comprising the step of said dealer altering said independent bank hands prior to said comparison.

9. A method of playing a card game according to claim 1 further comprising the step of said dealer reviewing said independent bank hands and designating which said set of different predetermined hand ranking rules will be applied to each of said independent bank hands.

10. A method of playing a card game according to claim 9 further comprising the step of said player altering said single hand prior to said comparison.

11. A method of playing a card game according to claim 9 further comprising the step of said dealer altering said independent bank hands prior to said comparison.

12. A method of playing a card game between at least two players, with a dealer who does not play, comprising the steps of:

selecting one player to act as a bank player, a dealer dealing said bank player a plurality of independent bank hands, wherein said plurality of independent bank hands are never commingled or combined, wherein a different set of predetermined hand ranking rules is applied to each said independent bank hand, said dealer dealing a player only a single hand, upon viewing said single hand, said player applying at least one of said different set of predetermined hand ranking rules to said single hand, a comparison being made between said single hand and all of said plurality of independent bank hands that utilize a identical set of hand ranking rules as said single hand, and upon completion of said comparison, a winning hand is determined using said identical set of hand ranking rules as a criteria.

13. A method of playing a card game according to claim 12 wherein the number of said plurality of independent bank hands is two.

14. A method of playing a card game according to claim 13 wherein said different predetermined sets of hand ranking rules are Standard Poker and Lowball Poker.

15. A method of playing a card game according to claim 13 wherein said different predetermined sets of hand ranking rules are Blackjack and Baccarat.

16. A method of playing a card game according to claim 12 wherein the number of said plurality of independent bank hands is three.

17. A method of playing a card game according to claim 16 wherein said different predetermined sets of hand ranking rules are Blackjack, Baccarat, and Seven-and-a-Half.

18. A method of playing a card game according to claim 12 further comprising the step of said player altering said single hand prior to said comparison.

19. A method of playing a card game according to claim 12 further comprising the step of said bank player altering said independent bank hands prior to said comparison.

20. A method of playing a card game according to claim 12 further comprising the step of said bank player reviewing said independent bank hands and designating which of said different set of predetermined hand ranking rules will be applied to each of said independent bank hands.

21. A method of playing a card game according to claim 20 further comprising the step of said player altering said single hand prior to said comparison.

22. A method of playing a card game according to claim 20 further comprising the step of said bank player altering said independent bank hands prior to said comparison.

23. A method of playing a card game between a dealer and at least one player comprising the steps of:

providing a plurality of different predetermined hand ranking rules, with each said plurality of different predetermined hand ranking rules designating a predetermined minimum winning hand rank, a player placing a wager, a dealer dealing said player only a single hand, with no cards dealt to said dealer, a plurality of values of said single hand being determined utilizing all of said different predetermined hand ranking rules, and said dealer paying said player a predetermined amount based upon said wager for all of said plurality of values of said single hand that have achieved said predetermined minimum winning hand rank or greater, said dealer collecting said player's wager if said value of said single hand is not any of said predetermined minimum winning hand ranks.

24. A method of playing a card game according to claim 23 wherein the number of said plurality of different hand ranking rules is two.

25. A method of playing a card game according to claim 24 wherein said different predetermined hand ranking rules are Standard Poker and Lowball Poker.

26. A method of playing a card game according to claim 25 wherein said predetermined minimum winning hand ranks are Pair of Tens for Standard Poker, and 9, 8, 7, 6, 5 for Lowball Poker.

27. A method of playing a card game according to claim 24 wherein said different predetermined hand ranking rules are Blackjack and Baccarat.

28. A method of playing a card game according to claim 27 wherein said predetermined minimum winning hand ranks are Seventeen for Blackjack, and Seven for Baccarat.

29. A method of playing a card game according to claim 23 wherein the number of said plurality of different hand ranking rules is three.

30. A method of playing a card game according to claim 29 wherein said different predetermined hand ranking rules are Blackjack, Baccarat, and Seven-and-a-Half.

31. A method of playing a card game according to claim 30 wherein said predetermined minimum winning hand ranks are Seventeen for Blackjack, Seven for Baccarat, and Six for Seven-and-a-Half.

32. A method of playing a card game according to claim 23 further comprising the step of said player altering said single hand prior to said plurality of values being determined.

33. A method of playing a card game according to claim 32 further comprising the step of said player applying at least one of said plurality of different hand ranking rules to said single hand prior to altering said single hand.

* * * * *